United States Patent [19]

Damaschini

[11] 4,335,475

[45] Jun. 22, 1982

[54] COMPOSITE LOUNGE CHAIR STRUCTURE

[76] Inventor: Pietro Damaschini, Via XXV Aprile, 35 - Muggio' (Prov. of Milano), Italy

[21] Appl. No.: 108,975

[22] Filed: Jan. 2, 1980

[30] Foreign Application Priority Data

Jan. 10, 1979 [IT] Italy ..... 20463/79[U]

[51] Int. Cl.[3] ..... A47C 17/04; A47C 17/22

[52] U.S. Cl. ..... 5/14; 5/36

[58] Field of Search ..... 5/13, 14, 27, 28, 37 R, 5/42, 52, 36; 297/218, 219

[56] References Cited

U.S. PATENT DOCUMENTS 3,121,237 2/1964 Brindisi ..... 5/36
3,221,348 12/1965 Siegel ..... 5/28

FOREIGN PATENT DOCUMENTS 2377788 8/1978 France ..... 5/13
1236587 2/1969 United Kingdom ..... 5/37

*Primary Examiner*—Alexander Grosz
*Attorney, Agent, or Firm*—Guido Modiano; Albert Josif

[57] ABSTRACT

A bed-convertible composite lounge chair comprises a base body whereto a backrest is removably associated in such a way as to define a structural framework. In the base body a cavity is formed housing a collapsible bed-spring, a covering being laid on the framework and having a first portion spanning from the backrest and the side surface of the base body and a second portion spanning the seat, these portions being effective to house a backrest cushion and a seat cushion respectively.

1 Claim, 5 Drawing Figures

COMPOSITE LOUNGE CHAIR STRUCTURE

BACKGROUND OF THE INVENTION

This invention relates to a composite lounge chair structure which is convertible into a bed.

Currently known are several types of lounge chairs suitable for conversion into beds, their constructions being based upon a variety of designs but sharing as a common feature the inclusion of a wire lath spring, intended for folding in a desired way, and its related mattress.

All bed-convertible lounge chairs of conventional design generally comprise a lounge chair framework which is quite complex and expensive, and have the serious drawback that their bulk size cannot be reduced for transportation. This is indeed an important aspect because the volume requirements of a lounge chair are quite considerable on account of a base body and backrest thereof extending in two different directions, thus increasing the bulk of the lounge chair for shipment and transportation.

SUMMARY OF THE INVENTION

Therefore, the task of the present invention is to obviate the aforementioned drawbacks by providing a composite lounge chair structure which is convertible into a bed, and which in addition to having a highly simplified structure, affords the significant advantage that its bulk size can be reduced for shipment and transportation.

Within this task, it is an object of the invention to provide a composite lounge chain structure which is convertible into a bed, wherein any of the various folding bed spring structures normally available on the market can be quickly incorporated without requiring any special adaptations for the attachment thereof.

Another object of the invention is to provide a composite lounge chair structure which is convertible into a bed and results from novel construction criteria, thereby the upholstery can be quickly and easily removed for routine cleaning purposes.

Another object of this invention is to provide a composite lounge chair which is convertible into a bed, and while being extremely simple from a constructional standpoint, ensures the utmost degree of reliability and comfort.

Yet another object of this invention is to provide a composite lounge chair structure which is convertible into a bed, and can be formed from readily available elements, while having a very reasonable cost.

The aforesaid task and objects, such as will be apparent hereinafter, are achieved by a bed-convertible lounge chair structure characterized in that it comprises a base body formed by tubular members, a backrest adapted for removable association with said base body such as to define a framework therewith, a cavity defined in said base body, a foldable bedspring arranged to be housed in a folded condition in said base body, a first covering portion on said framework and spanning said backrest and the side surface of said base body, a second covering portion spanning the seat, a backrest cushion inserted in said first covering portion, and a seat cushion inserted in said second portion.

BRIEF DESCRIPTION OF THE DRAWINGS

Further features and advantages will be more clearly understood from a detailed description of a composite lounge chair structure which is convertible into a bed, illustrated by way of example and not of limitation in the accompanying drawing, where.

DESCRIPTION OF THE PREFERRED EMBODIMENTS

Figure 1:
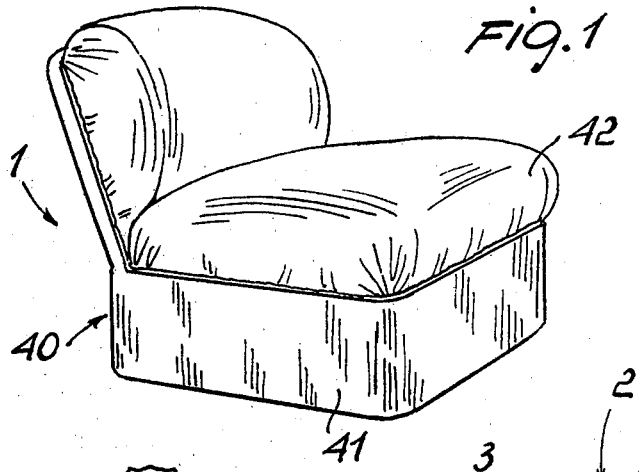
FIG. 1 shows schematically a composite lounge chair structure which is convertible into a bed, according to the invention.
Figure 2:
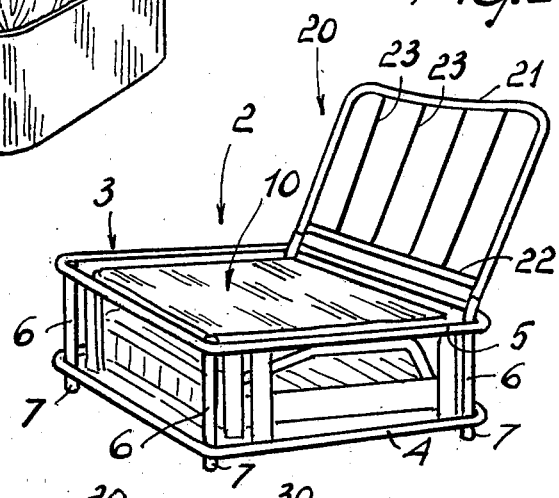
FIG. 2 is a perspective view of the lounge chair framework.
Figure 5:
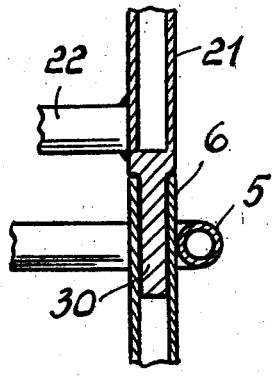
FIG. 5 is a sectional detail view of the backrest connection to the base body.
Figure 3:
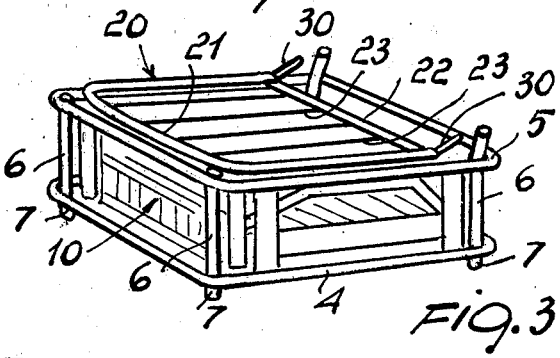
FIG. 3 shows schematically the lounge chair framework in its position for shipment or transportation.
Figure 4:
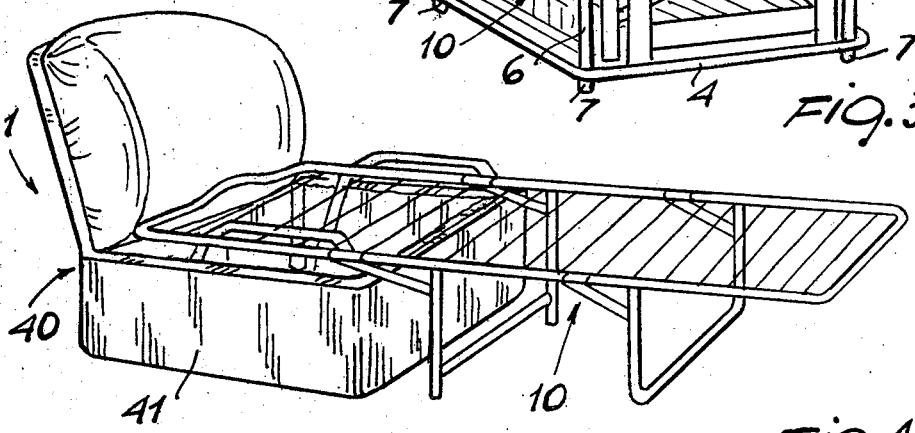
FIG. 4 shows the lounge chair as converted into a bed.

With reference to the cited drawings figures, the composite lounge chair structure which is convertible into a bed, as generally indicated at 1, comprises a framework 2 which includes a base body 3 formed from tubular members.

Specifically, the base body 3 comprises a lower frame 4 of closed configuration, and an upper frame 5, also of closed configuration, which are joined by vertically extending uprights 6 welded both to the frame 4 and frame 5. Said uprights 6 project downwardly from the frame 4 to define resting feet 7; moreover, the rearwardly located uprights 6 are provided with means for connecting the backrest thereto, as will be explained hereinafter.

The cited base body, having the configuration just described, defines in practice a cavity or open area therein, into which cavity a folding bedspring, indicated at 10 and no further described herein because of a type known per se, can be inserted. The bedspring 10, as will be more clearly explained hereinafter, can be easily pulled out from the lounge chair to serve, in its extended condition, as a support for the mattress, which can be folded, as usual, into the lounge chair and stowed therein for reuse.

The backrest 20 of the lounge chair is removably connected to the base body, and comprises a metal tube frame 21 of U-like shape, the free legs whereof are interconnected at their ends by a crosspiece 22. Furthermore, between the crosspiece 22 and the central portion of the frame 21, there extend tie rods 23 which act as backrest forming elements.

The connection of the backrest 20 to the base body 2 can be effected by inserting lugs 30, which are provided as an extension of the ends of the legs of the frame 21, into the top ends of the vertical uprights 6 located on the rear.

The lounge chair structure which is convertible into a bed, according to the invention, further includes a covering having a first portion 40 formed with a pouch for insertion over the backrest 20, which defines a side band 41 which fits in practice around the side surface of the base body.

Moreover, the covering includes a second portion 42 formed by the seat covering and adapted for fitting over the top of the base body. Into said first and second portions, there can be respectively inserted a backrest cushion and a seat cushion having any desired shape.

The composite lounge chair structure according to the invention is extremely simple to use. In fact, by simply removing its seat, the chair can be utilized in a quite similar manner to traditional bed-convertible lounge chairs, a unique feature being that in its shipment or transportation condition, the backrest can be detached from the base body 3 by disengaging the lugs from the uprights 6 and placing the backrest onto the base body, to reduce in a most drastic manner the bulk size of the lounge chair.

Another important feature is that the covering can be easily assembled and disassembled to/from the framework, thus affording the possibility of easily providing for the cleaning thereof.

To interconnect several such lounge chairs as described hereinabove together, conventional bridges of a plastics material are provided which engage with the frames 4 of adjacent lounge chairs.

Also apparent is that the instant lounge chair permits a sitting room to be conveniently furnished wherein but one or more chairs will enclose a bedspring 10 whereas the remaining ones, while exhibiting the same outward configuration, will have no bedsprings therein, in which case the seat would be formed by tie rods carried by the upper frame 5 quite similarly to the backrest tie rods.

On the same principle, a couch which is convertible into a double bed may be produced, all such embodiments being similar to the one described hereinabove and only differring in size.

A further significant advantage is that the framework is made up of tubular members, which are extremely quick and simple to assemble and allow the manufacturing costs to be drastically cut down.

In practicing the invention, the materials used and the shapes and dimensions can be any ones to suit individual requirements.

I claim:

1. A bed-convertible lounge chair structure, characterized in that it comprises a base body formed by tubular members, a backrest adapted for removable association with said base body such as to define a framework therewith, a cavity defined in said base body, a foldable bedspring arranged to be housed in a folded condition in said base body, a first covering portion on said framework and spanning said backrest and the side surface of said base body, a second covering portion spanning the seat, a backrest cushion inserted in said first covering portion, and a seat cushion inserted in said second portion, said base body comprising a closed configuration lower frame and a closed configuration upper frame and vertically extending uprights uniting said frames together at the corners thereof, said backrest comprising a tubular peripheral frame substantially of U-like shape having legs corresponding to the legs of the U-like shape and a peripheral frame portion corresponding to the bridge of the U-shape, said legs having distal ends remote from said peripheral frame portion and proximal ends connected to said peripheral frame portion, an interconnecting crosspiece at the distal ends of said peripheral frame legs and connected thereto, and tie rods extending between said crosspiece and said peripheral frame portion and transverse thereto, said peripheral frame of said backrest having lugs at the free ends of the legs thereof and at least those of said vertically extending uprights located on the rear of said base body having upwardly open cavities for removably receiving therein said lugs said base body defining thereby a space for receiving therein said foldable bed spring.

* * * * *